US009517477B2

(12) United States Patent
Takahashi et al.

(10) Patent No.: US 9,517,477 B2
(45) Date of Patent: Dec. 13, 2016

(54) CENTRIFUGE AND CENTRIFUGE OPERATION INFORMATION COLLECTING SYSTEM

(75) Inventors: Hiroyuki Takahashi, Ibaraki (JP); Hisanobu Ooyama, Ibaraki (JP)

(73) Assignee: HITACHI KOKI CO., LTD., Tokyo (JP)

( * ) Notice: Subject to any disclaimer, the term of this patent is extended or adjusted under 35 U.S.C. 154(b) by 1050 days.

(21) Appl. No.: 13/038,410

(22) Filed: Mar. 2, 2011

(65) Prior Publication Data

US 2011/0230327 A1 Sep. 22, 2011

(30) Foreign Application Priority Data

Mar. 16, 2010 (JP) ..... 2010-060011

(51) Int. Cl.
*B04B 13/00* (2006.01)
*B04B 5/10* (2006.01)
*B04B 9/10* (2006.01)

(52) U.S. Cl.
CPC ..... *B04B 13/00* (2013.01); *B04B 5/10* (2013.01); *B04B 9/10* (2013.01)

(58) Field of Classification Search
CPC .... B04B 13/00; B04B 2013/00; B04B 13/003; B04B 2013/006
USPC ..... 494/10, 11
See application file for complete search history.

(56) References Cited

U.S. PATENT DOCUMENTS 5,428,470 A * 6/1995 Labriola, II ..... 398/109
5,492,831 A * 2/1996 Ranger ..... 436/50
5,721,676 A 2/1998 Bolden et al.
7,396,324 B2 * 7/2008 Tetsu et al. ..... 494/7
7,430,478 B2 * 9/2008 Fletcher-Haynes et al. ... 702/21
2005/0107235 A1 5/2005 Tetsu et al.
2007/0277228 A1 * 11/2007 Curtis ..... H04L 63/083 726/4
2008/0251436 A1 * 10/2008 Tetsu et al. ..... 210/145
2014/0235421 A1 * 8/2014 Rogers ..... B04B 5/0442 494/10
2015/0057141 A1 * 2/2015 Toi ..... B04B 5/10 494/10

FOREIGN PATENT DOCUMENTS

JP 10-511489 A 11/1998
JP 2000-246147 A 9/2000
JP 2002-272018 A 9/2002
(Continued)

OTHER PUBLICATIONS

Japanese Office Action for the related Japanese Patent Application No. 2010-060011 dated Jan. 28, 2013.

*Primary Examiner* — Charles Cooley
*Assistant Examiner* — Marc C Howell
(74) *Attorney, Agent, or Firm* — Kenealy Vaidya LLP

(57) ABSTRACT

A centrifuge includes: a driving unit; a rotor configured to be rotated by the driving unit and hold a sample; a control unit configured to control rotation of the driving unit; and a communication controller configured to communicate with an external network. The control unit has an automatic transmission mode in which operation data is collected at predetermined intervals while the centrifuge is operating and the operation data is periodically transmitted to a data managing apparatus through the network.

15 Claims, 9 Drawing Sheets

(56) References Cited

FOREIGN PATENT DOCUMENTS

| | | | |
|---|---|---|---|
| JP | 2005-121505 | A | 5/2005 |
| JP | 2007-44569 | A | 2/2007 |
| JP | 2008-242805 | A | 10/2008 |

* cited by examiner

CENTRIFUGE AND CENTRIFUGE OPERATION INFORMATION COLLECTING SYSTEM

BACKGROUND

The disclosure relates to a centrifuge operation information collecting system using a plurality of centrifuges having a function of rotating a rotor with a set sample at high speed, and a data managing apparatus collecting operation data from the centrifuges through a network.

In a manufacturing process of a vaccine or medicine, a centrifuge is used to separate a virus, a cultured cell, and cultured bacteria from a raw material. In addition, blood sampled by blood donation is brought together in a blood center, and a centrifuge is used for its pretreatment in medicine manufacturing and formulation. In the past, for the manufacturing of a vaccine or a medicine, manufacturing standards for aspects of software and hardware, called GMP (Good Manufacturing Practice), were established, and the vaccine or medicine should be manufactured under a facility or management based on GMP. In order to meet the demands of GMP, a large amount of data for managing all the processes including the centrifuge is needed, and these data items are forced to be kept on paper.

For example, according to the demands of the GMP, information on who operated the centrifuge under what conditions, setting states such as the number of rotations, temperature, and an operation period of a centrifuge, and an operation state are managed. In a case where an operator only leaves data recorded on paper, it is difficult to completely prevent human mistakes, such as a recording mistake or an omission. In order to solve the inconvenience caused by the storage of data using paper, guidelines which allow managing electronic data as a formal record instead of paper (for example, chapter 11, article 21 of Federal Regulations: guidelines for electronic recording and electronic signature) have been established so that the operation records of a centrifuge can be stored as electronic data.

In order to perform electronic recording based on the above guidelines, a method of performing recording by connecting one data managing apparatus to one centrifuge or a method of collectively managing the operation information of a plurality of centrifuges by one data managing apparatus manages is known. As an example of the method of connecting one data managing apparatus to one centrifuge, a technique disclosed in JP2000-246147A is known. However, when a few to dozens centrifuges are used in medicine manufacturing or formulation work, it is uneconomical to prepare one data managing apparatus for each centrifuge in terms of cost or installation locations. Accordingly, it is preferable that one data managing apparatus manages the operation information collectively.

In the technique disclosed in JP2000-246147A, a centrifuge and a data managing apparatus (information acquisition apparatus), which monitors an operation state of the centrifuge, are connected to each other in a one-to-one manner. However, it is difficult for the data managing apparatus to monitor a plurality of centrifuges simultaneously using this technique. Moreover, in the technique disclosed in JP2000-246147A, an information analyzer connected to the information acquisition apparatus through a LAN is provided. However, this information analyzer communicates with a data managing apparatus only when a centrifuge is not operating or when the lifespan of a driving unit or a rotor is approaching its end or ends. For this reason, this is not a technique for performing remote collection of operation state data in real time.

In addition, an operation information collecting system which uses one data managing apparatus to monitor operation states of a plurality of centrifuges connected to the data managing apparatus through a network has also been proposed. The flow chart in FIG. 9 shows the processing procedure of a data managing apparatus in such a method. Referring to FIG. 9, when one data managing apparatus manages a plurality of centrifuges, the data managing apparatus determines one of the plurality of managed centrifuges (step 101) and transmits a request for transmission of operation data to the determined centrifuge through a network (step 102). The centrifuge which has received the transmission request for operation data collects the operation data at that time and converts it into operation data with a predetermined format and then transmits it to the data managing apparatus. The data managing apparatus receives the operation data transmitted from the centrifuge (step 103) and stores the operation data in a storage device of the data managing apparatus (step 104). Then, the process returns to step 101 to manage the plurality of centrifuges while changing the target centrifuge in a sequential manner.

SUMMARY

In the operation information collecting system which uses the procedure shown in FIG. 9, the data managing apparatus serving as a managing server needs to transmit an operation data transmission request signal to the managed centrifuges whenever the transmission of operation data is needed. Accordingly, there is a problem in that the load of the managing server is increased. In addition, the managing server transmits a transmission request signal regardless of whether or not a centrifuge is in an ON state. Accordingly, for example, if there are many managed centrifuges and most of the centrifuges are in OFF states according to time circumstances, such as night or a holiday, a large amount of useless data (transmission request signals) flows into the shared network facility. This reduces line utilization efficiency. Moreover, in order to transmit a command to all the managed centrifuges, the managing server should register the address of each centrifuge in advance. In this case, it is troublesome work to have to manually input addresses for communication management, model names or serial numbers of actual centrifuges, and the like.

On the other hand, in recent years when network facilities including the Internet and intranet have become widespread, a method for connecting a centrifuge using the existing network is economical rather than providing a new exclusive line by building a communication system including the centrifuge. Currently, the most popular information network is a network based on IEEE 802.3 specifications or a wireless network based on IEEE 802.11 specifications. Both the networks have a function for the prevention of data collision caused by simultaneous communication. Therefore, even if a plurality of apparatuses tries to transmit data simultaneously to one data processor, a collision is avoided, and all data items are successfully transmitted to the data processor without data loss.

One aspect of the disclosure has been made in view of the above-described background, and it is an object of the one aspect to provide a centrifuge and a centrifuge operation information collecting system capable of efficiently collecting the operation data of a plurality of centrifuges with a small number of data managing apparatuses using a known network.

In addition, it is another object to provide a centrifuge capable of transmitting its operation data to a data managing apparatus spontaneously and efficiently.

In addition, it is still another object to provide a centrifuge operation information collecting system capable of efficiently collecting the information regarding a plurality of centrifuges in a specific data managing apparatus by allowing the operation data to be transmitted through the network facility only when a centrifuge is in an ON state.

According to a first aspect of the disclosure, a centrifuge includes:

a driving unit;

a rotor configured to be rotated by the driving unit and hold a sample;

a control unit configured to control rotation of the driving unit; and a communication controller configured to communicate with an external network, wherein the control unit has an automatic transmission mode in which operation data is collected at predetermined intervals while the centrifuge is operating and the operation data is periodically transmitted to a data managing apparatus through the network.

According to a second aspect of the disclosure, in the centrifuge of the first aspect, whether to set the automatic transmission mode or not is selectable in the centrifuge.

According to a third aspect of the disclosure, in the centrifuge of the second aspect, the control unit detects whether or not the network is in a communicable state, and sets the automatic transmission mode to on so that the operation data is transmitted if the network is in a communicable state.

According to a fourth aspect of the disclosure, in the centrifuge of the third aspect, the control unit detects whether or not the network is in a communicable state, and sets the automatic transmission mode to off so that the operation data is not transmitted if the network is not in a communicable state.

According to a fifth aspect of the disclosure, in the centrifuge of the third or fourth aspect, the operation data transmitted to the network includes unique information regarding a transmission source.

According to a sixth aspect of the disclosure, in the centrifuge of the fifth aspect, wherein the unique information is a unique address on the network assigned to the centrifuge.

According to a seventh aspect of the disclosure, in the centrifuge of the sixth aspect, the control unit transmits the operation data at fixed intervals until the centrifuge is powered off after the centrifuge is powered on.

According to an eight aspect of the disclosure, a centrifuge operation information collecting system includes:

a plurality of centrifuges, each of which includes: a driving unit; a rotor configured to be rotated by the driving unit and hold a sample; a control unit configured to control rotation of the driving unit; and a communication controller configured to communicate with an external network and transmit operation data from the control unit at predetermined intervals; and a data managing apparatus which receives and records the operation data transmitted from the centrifuges, wherein the data managing apparatus determines unique information regarding a transmission source from the operation data transmitted from the centrifuges and records the unique information for every model of the centrifuges.

According to the first aspect of the disclosure, since the control unit of the centrifuge has an automatic transmission mode in which the operation data is collected at predetermined intervals while the centrifuge is operating and the operation data is periodically transmitted to the data managing apparatus through the network, the information is transmitted to the network only when the centrifuge is in an ON state. Therefore, since useless data is not transmitted on the network when the centrifuge is in an OFF state, the load of the network can be reduced. Moreover, since the operation data is spontaneously transmitted from each centrifuge even if the data managing apparatus 1 does not send an operation data transmission request to each centrifuge, the processing procedure of the data managing apparatus 1 is simplified. Therefore, the operation data of a plurality of centrifuges can be collected and recorded efficiently.

According to the second aspect of the disclosure, since whether to set the automatic transmission mode to ON or OFF can be selected in the centrifuge, it is possible to collect the operation data of only a centrifuge for which data management is required. In addition, entirely the same usage as in a centrifuge in the related art can be applied by setting the automatic transmission mode to OFF.

According to the third aspect of the disclosure, the control unit of the centrifuge detects whether or not the network is in a communicable state, and sets the automatic transmission mode to ON so that the operation data is transmitted when the network is in a communicable state. Therefore, the operator does not need to set a transmission mode, and the transmission mode can be automatically set at the centrifuge side.

According to the fourth aspect of the disclosure, the control unit of the centrifuge detects whether or not the network is in a communicable state, and sets the automatic transmission mode to OFF so that the operation data is not transmitted when the network is not in a communicable state. Therefore, the operator does not need to set a transmission mode, and the transmission mode can be automatically set at the centrifuge side.

According to the fifth aspect of the disclosure, since the operation data transmitted to the network includes unique information regarding a transmission source, the data managing apparatus can acquire the unique information regarding a centrifuge which is in an ON state in the network. Moreover, when registering a centrifuge to be managed by the data managing apparatus, it is possible to alleviate the work of the operator in manually inputting the unique information regarding a centrifuge, for example, information including a type, a serial number, and the like.

According to the sixth aspect of the disclosure, since the unique information regarding a transmission source is a unique address on the network assigned to a centrifuge, it is possible to use information, such as a widely used IP address, without setting the new identification information for identification of a transmission source.

According to the seventh aspect of the disclosure, the control unit transmits the operation data at fixed intervals until the centrifuge is powered off after the centrifuge has been powered on. Therefore, since the data managing apparatus can collect the operation data without omissions by just receiving the transmitted data, its management efficiency can be significantly improved.

According to the eighth aspect of the disclosure, in a centrifuge operation information collecting system including a data managing apparatus which receives and records the operation data transmitted from a plurality of centrifuges, the data managing apparatus determines unique information regarding a transmission source from the operation data transmitted from the centrifuge and records the unique information regarding a transmission source for every model. Therefore, the operation information collecting system of the disclosure can be easily realized by just connecting a centrifuge and a data managing apparatus to a network, such as the widely used Internet.

The above, other objects, and novel features of the disclosure will become apparent from the following description with reference to the accompanying drawings.

DESCRIPTION OF EXEMPLARY EMBODIMENTS

First Embodiment

Figure 1:
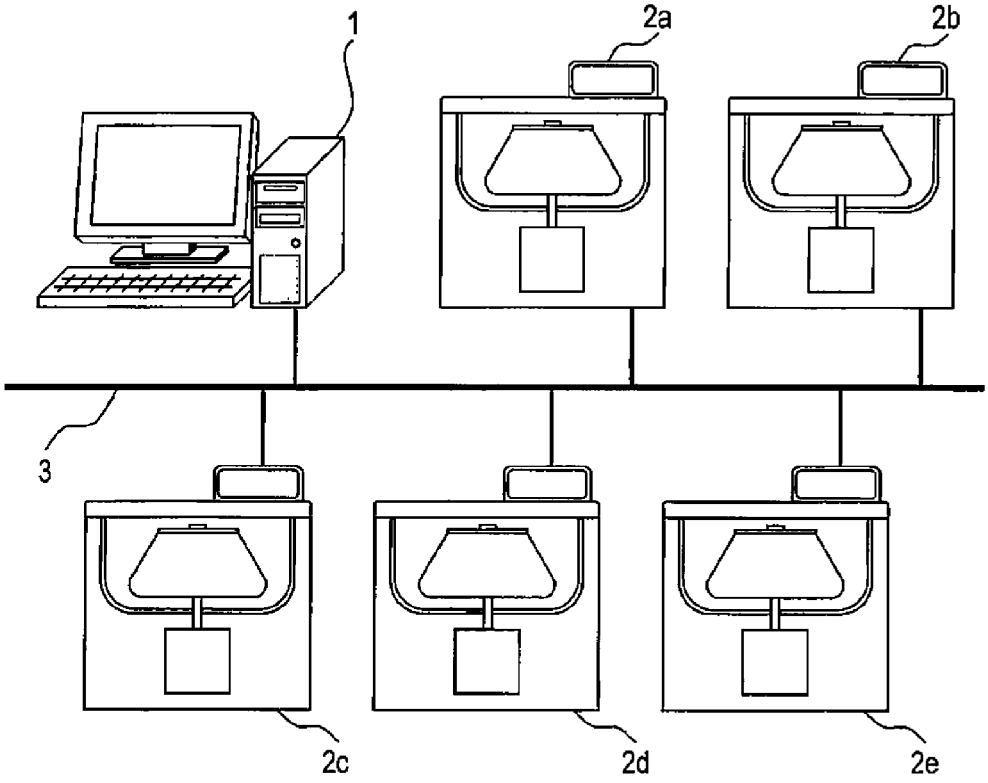
FIG. 1 is a view showing the entire configuration of a centrifuge operation information collecting system according to an exemplary embodiment.

Hereinafter, exemplary embodiments will be described with reference to the accompanying drawings. Moreover, in the following drawings, the same sections are denoted by the same reference numerals, and repeated explanations thereof will be omitted.

FIG. 1 is a view showing the entire configuration of a centrifuge operation information collecting system according to the exemplary embodiment. In the system of the embodiment, five centrifuges 2 (2*a* to 2*e*) are connected to one data managing apparatus 1 through a network 3. As the data managing apparatus 1, a general-purpose personal computer can be used. The data managing apparatus 1 receives operation data, which will be described later, transmitted from the centrifuge 2 and counts and records it. Each centrifuge 2 includes a rotor for holding a sample, a motor for rotating the rotor, a control unit which controls rotation of the rotor, and a communication controller for communication with an external network. In the embodiment, the centrifuges 2*a* to 2*e* may be the same model or may be different models. For example, an ultracentrifuge with a maximum rotation speed of 150,000 rpm may be used as the centrifuge 2*a*, and a centrifuge for blood separation with a maximum rotation speed of 7,000 rpm may be used as the centrifuge 2*b*. If the centrifuges 2*a* to 2*e* are different models, the types, diameters, and the maximum number of rotations of rotors that can be set may be different, and there may be a difference in the existence of a cooling device, the existence of a vacuum pump, and the like. In addition, the number of centrifuges 2 connected is not limited, and the plurality of centrifuges 2 may be connected to each other in consideration of the capacity of the network 3 or the throughput of the data managing apparatus 1.

As the network 3, a known network technique may be used. For example, a network based on IEEE 802.3 specifications which are widespread may be used. This is preferable especially in the case of connecting the plurality of centrifuges 2 to each other because there is a function of avoidance of data collision on the network line. In addition, unique addresses are given to the data managing apparatus 1 and each centrifuge 2 in order to identify them. Using these unique addresses, each of the plurality of centrifuges 2 connected to the network can transmit the information to the specific data managing apparatus 1. In the embodiment, a system that adopts TCP/IP, which is used as a communication protocol in IEEE 802.3 specifications in many cases, is assumed and an IP address (Internet Protocol Address) is used as each address.

Using TCP/IP and IP addresses, communication of the information between apparatuses with unique IP addresses becomes possible. In order to do so, the data managing apparatus 1 and the centrifuge 2 need to have unique IP addresses. In addition, each centrifuge 2 needs to know the IP address of the data managing apparatus 1. The IP address of the data managing apparatus 1 is recorded in a program for the centrifuge 2 or recorded in a configuration file recorded in a programmable region. Since the IP address of the centrifuge 2 can be added by the function of the TCP/IP when transmitting the information on the centrifuge 2 to the data managing apparatus 1 through the Internet or the like, the data managing apparatus 1 will know the IP address of the centrifuge 2.

In the embodiment, the size of the network 3 is not limited. For example, a local area network (LAN), a wide area network (WAN), or a network using the Internet may be used. The installation places of the data managing apparatus 1 and the centrifuges 2*a* to 2*e* do not matter if they are within a range where connection to the network 3 is possible. For example, they all may be installed in the same room, or the data managing apparatus 1 may be set in a head office and the centrifuge 2 may be installed in each branch office in a distributed way.

Figure 2:
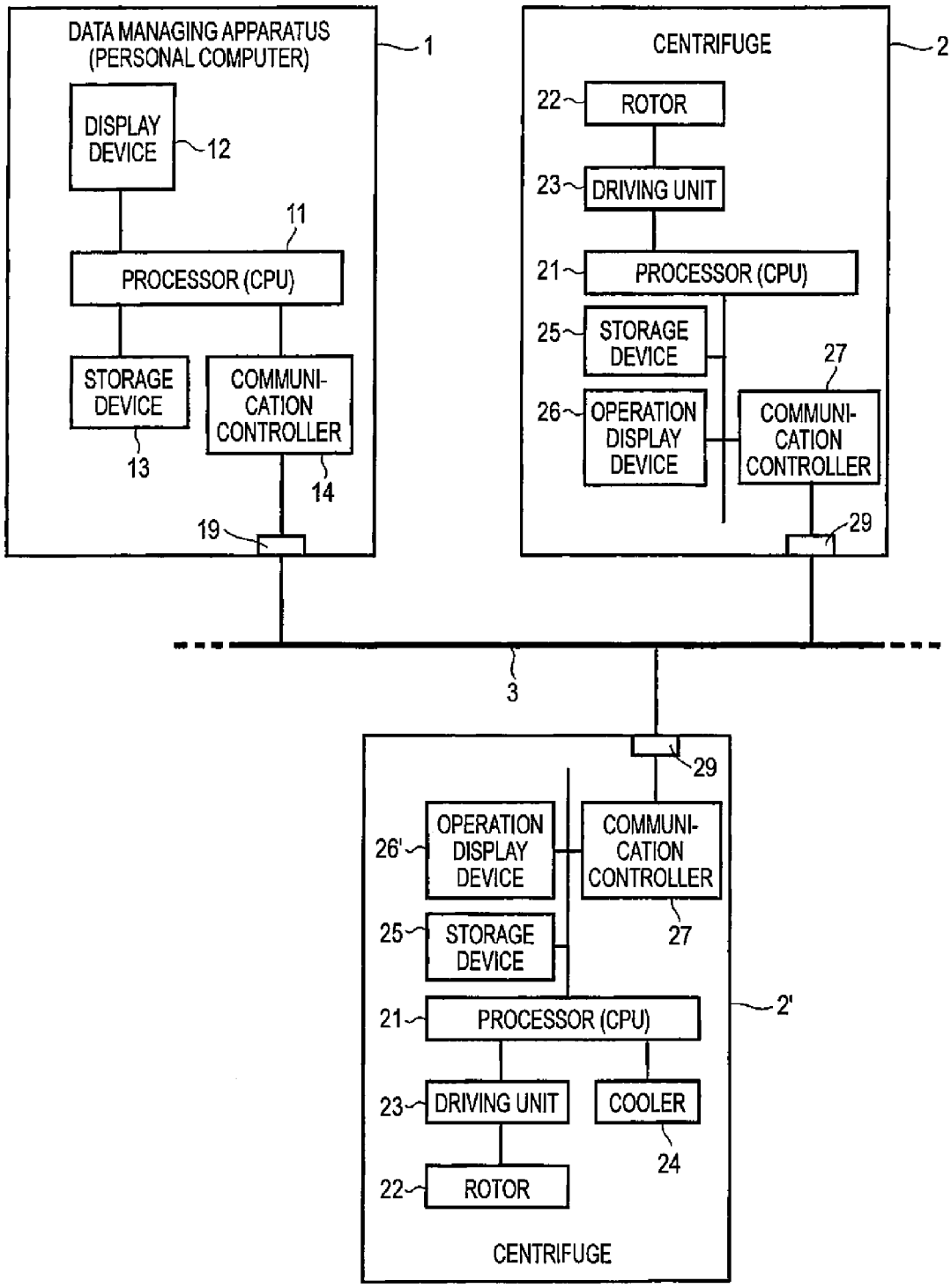
FIG. 2 is a block diagram showing the control circuit configurations of a data managing apparatus 1 and centrifuges 2 and 2' according to the embodiment.

FIG. 2 is a block diagram showing the control circuit configurations of the data managing apparatus 1 and the centrifuges 2 and 2' according to the embodiment. The data managing apparatus 1 is configured to include a processor (CPU) 11 which is a general-purpose personal computer, a display device 12 such as a liquid crystal display device which displays information, a storage device 13 such as a RAM or a hard disk device, and a communication controller 14 for connection to the network 3. Although the configuration included in the data managing apparatus 1 is not limited only to these, a further explanation will be omitted since the internal configuration is well known. In the communication controller 14, a connector 19 used for mounting of a cable connected to the network 3 is provided.

The centrifuge 2 is configured to include a rotor 22 which rotates in a state where a sample is held, a driving unit 23 such as a motor for rotating the rotor 22, and a processor 21 that controls the driving unit 23. A storage device 25 such as a RAM or a hard disk device, an operation display device 26 such as a touch type liquid crystal display panel provided in an upper part of the centrifuge 2, and a communication controller 27 for transmission of information to/from the network 3 are connected to the processor 21. In the communication controller 27, a connector 29 used for mounting of a cable connected to the network 3 is provided. In addition, the centrifuge 2*a* may be provided with a vacuum pump (not shown) which decompresses an inside of a chamber, an air leak valve for making the inside of the chamber communicate or not communicate with the surrounding air (outside the chamber), a vacuum sensor which measures the pressure in the chamber, a door lock for opening or closing a door, a cooler which cools the inside of the chamber which houses the rotor 22, and the like. For example, although the centrifuge 2' shown in FIG. 2 has almost the same configuration as the centrifuge 2, the centrifuge 2' has a cooler 24 having a cooling function.

Figure 3:
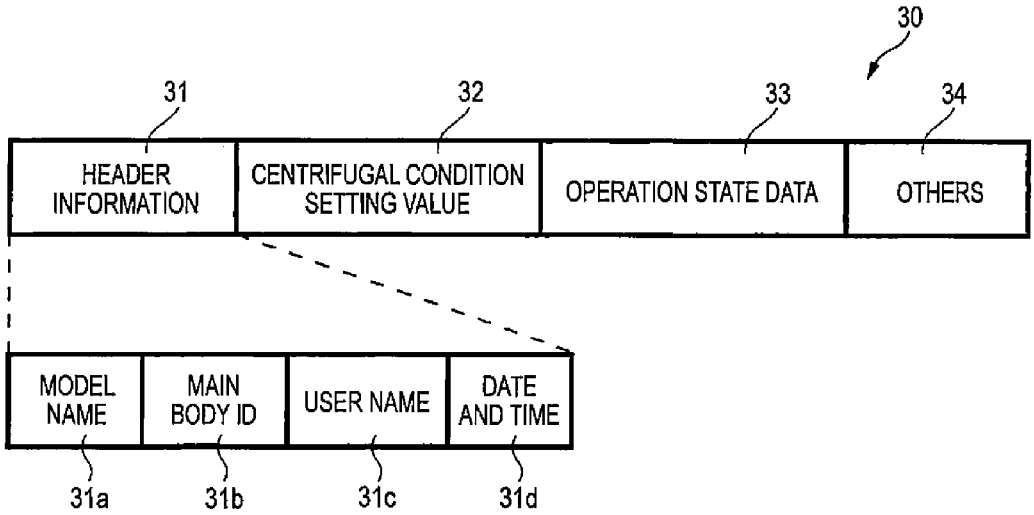
FIG. 3 is a view showing a format of operation data 30 transmitted from the centrifuge 2 to the data managing apparatus 1 which are shown in FIG. 1.

The IP address of the data managing apparatus 1 which is a managing server is recorded in a configuration file of the storage device 25 of the centrifuge 2. After the centrifuge 2 is powered on, the processor 21 creates the operation data of the centrifuge 2 at predetermined intervals and transmits it to the data managing apparatus 1 spontaneously. FIG. 3 is a view showing a format of operation data 30 transmitted from the centrifuge 2 to the data managing apparatus 1. The operation data 30 largely includes header information 31, a centrifugal condition setting value 32, operation state data 33, and others 34. The header information 31 includes a model name 31*a* of the centrifuge 2 which transmits it, a main body ID 31*b* such as a serial number or a management number of one or another customer, a user name 31*c* which becomes a login user name for logging on the data managing apparatus 1, and date and time 31*d* when the operation data 30 is transmitted. The centrifugal condition setting value 32 includes a setting value of the centrifuge 2, such as a temperature or a rotation speed of the rotor 22. The operation state data 33 includes data indicating the operation state, such as a temperature or a rotation speed of the rotor 22, at the time of transmission. The others 34 include not only other data transmitted additionally but also data required for network transmission of EOF (End of File) data, checksum, and the like.

Figure 4:
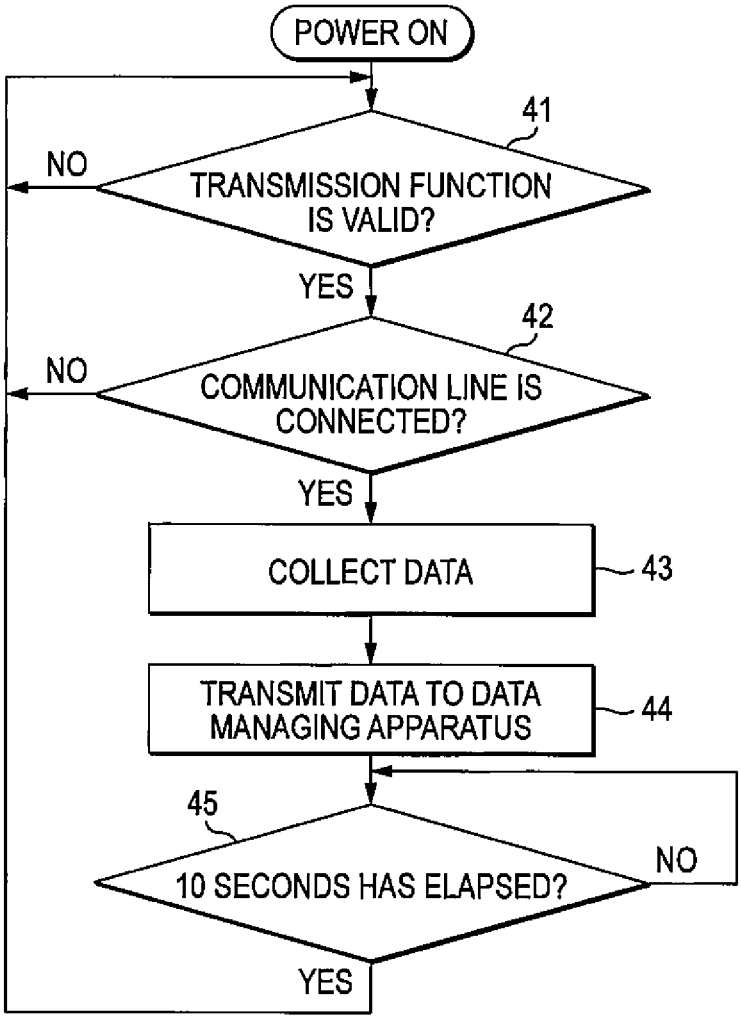
FIG. 4 is a flow chart showing the transmission procedure of the operation data 30 in the centrifuge 2 shown in FIG. 1.

Next, the transmission procedure of the operation data 30 in the centrifuge 2 will be described using a flow chart shown in FIG. 4. The procedure shown in the flow chart of FIG. 4 is realized by software when the processor 21 of the centrifuge 2 executes a program. When the centrifuge 2 is powered on, the processor 21 reads a processing program from the storage device 25 and executes it according to the starting procedure set in advance. First, the processor 21 determines whether or not a transmission function of transmitting the operation data 30 to the data managing apparatus 1 periodically is valid (step 41). In the embodiment, the centrifuge 2 has an automatic transmission mode in which the operation data is automatically transmitted to the data managing apparatus 1 at predetermined intervals. However, whether or not to set this automatic transmission mode may be arbitrarily set. If the automatic transmission mode is set to be invalid, it is also possible to perform a stand-alone operation without using a communication function even in the case of the centrifuge 2 including the communication controller 27.

Then, if the automatic transmission mode is valid, the processor 21 determines whether a network cable is connected to the connector 29 or a network cable is connected to the connector 29 and a communication is possible (step 42). If the automatic transmission mode is invalid (step 41) or if the automatic transmission mode is valid but it is not possible to use the network 3, the process returns to step 41 (step 42).

Then, the processor 21 collects the operation data to be transmitted to the data managing apparatus 1 (step 43). The content of the collected data may be arbitrarily set. In the embodiment, for example, a rotation speed of the rotor 22, an RCF state value, an operation time (elapsed time), rotor temperature, a degree of vacuum, a vacuum level, and an operation state (for example, a stopped state, an acceleration state, a deceleration state, a door state, and a state of a vacuum pump) are included. Then, the processor 21 aligns the collected operation data and adds the required information to convert it into the format of the operation data 30 shown in FIG. 3, and transmits it to the data managing apparatus 1 through the network 3 (step 44). A redundant configuration where a plurality of data managing apparatuses 1 is used in order to improve the reliability may also be adopted without being limited to the configuration where only one data managing apparatus 1 as a transmission destination is used. In this case, although the individual centrifuges 2*a* to 2*e* transmit the operation data 30 to the data managing apparatus 1 asynchronously, all of the operation data 30 are transmitted to the data managing apparatus 1 through the network 3 without collision.

After transmitting the operation data 30 to the data managing apparatus 1, the processor 21 waits for 10 seconds (step 45). After the waiting, the process returns to step 41 to repeat the processing. As described above, since the operation data 30 is automatically created at predetermined intervals in the centrifuge 2 and is then transmitted to the data managing apparatus 1 spontaneously, there is no need to transmit a command for a request of transmission from the data managing apparatus 1 to the operation data 30. Moreover, in the embodiment, whether to set the automatic transmission mode to valid or invalid is registered in a configuration file recorded on the storage device 25. However, the centrifuge may be configured to set the automatic transmission mode to ON if the IP address of the data managing apparatus 1 is set and the network 3 can be used accordingly and to set the automatic transmission mode to OFF if some conditions are missing.

Figure 5:
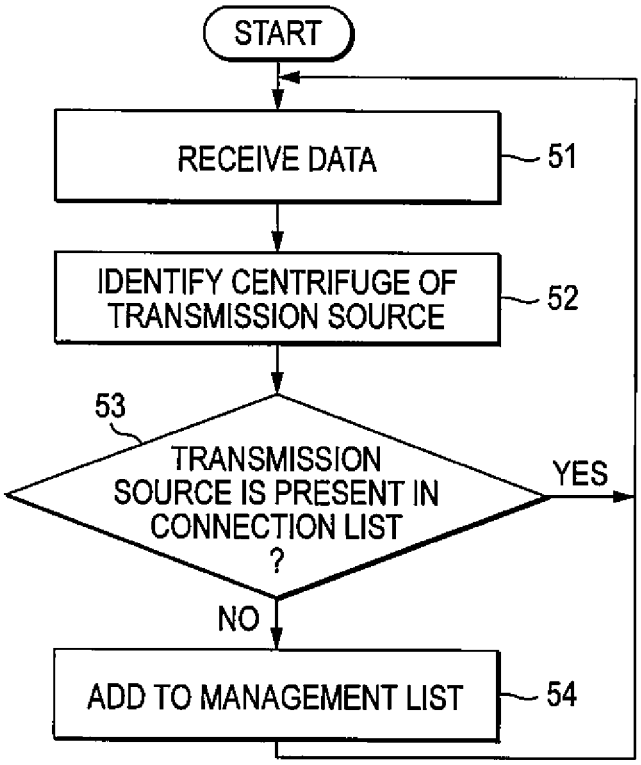
FIG. 5 is a flow chart showing the procedure of registration of an object to be managed (centrifuge 2) in the data managing apparatus 1.

Next, the processing procedure of the data managing apparatus 1 will be described using FIGS. 5 and 6. FIG. 5 is a flow chart showing the registration procedure of a connection list which is a candidate of an object to be managed (centrifuge 2) in the data managing apparatus 1. In the embodiment, the data managing apparatus 1 uses two kinds of lists, that is, a "connection list" which is a list of all centrifuges that transmitted data to the data managing apparatus in the past and a "management list" which is a list of the centrifuges 2 set as objects to be managed by manual selection of the administrator from the connection list. For example, it is assumed that in the configuration shown in FIG. 1, a centrifuge 2*f* (not shown) is newly purchased and connected to the network 3. In this case, the IP address of the data managing apparatus 1 is registered in the centrifuge 2*f* so that the automatic transmission mode is valid. Then, if the centrifuge 2*f* is powered on, the centrifuge 2*f* transmits the operation data 30 to the data managing apparatus 1 at predetermined intervals according to the procedure shown in the flow chart of FIG. 4.

If the data managing apparatus 1 receives the operation data 30 from the newly added centrifuge 2*f* (step 51), the data managing apparatus 1 identifies a model name and a main body ID of the transmission source from the header information 31 (step 52). Then, it is determined whether or not the transmission source (centrifuge 2*f*) of the received operation data 30 is registered in the connection list of the data managing apparatus 1 (step 53). If it is not registered, it is registered in the connection list and the process returns to step 51 (step 54). Here, the connection list is a list based only on the fact that there is a communication record. If it is registered, the process returns from step 53 to step 51. Thus, in the data managing apparatus 1, a connection list is automatically created by just transmitting the operation data 30 to the IP address of the data managing apparatus 1. Then, if the administrator has an intention to set the centrifuge 2*f* as an object to be managed, the administrator selects the centrifuge 2*f* from the connection list and additionally registers it in the management list. Here, the management list is a list of centrifuges 2 from which the operation data 30 is received and recorded at predetermined intervals. Various methods of registering a centrifuge in a management list may be considered. For example, when the new centrifuge 2*f* is connected to the connection list, a question "There is a new object to be connected. Do you want to register it (Y/N)" and the content of operation data transmitted from the centrifuge 2*f* may be displayed on the display device 12 of the data managing apparatus 1 and an instruction from the administrator may be received. In this case, the administrator's operation of inputting the detailed information regarding the added centrifuge 2*f* is made unnecessary by just selecting an icon indicating YES. As a result, the troublesome work of inputting each model name, main body ID, and unique IP address one by one can be omitted.

Although a detailed explanation is omitted in the embodiment, it is preferable to adopt a configuration where transmission of data from an unknown IP address or an unreliable IP address to the data managing apparatus 1 is blocked using a known firewall function. In addition, if the centrifuge which transmits operation data 30 is automatically registered in a connection list, the data of a centrifuge which transmits the data at least once remains permanently in the connection list. For this reason, old data whose validity has decreased after a predetermined time has elapsed may be deleted from the connection list. In addition, the centrifuge 2 which transmitted the operation data at least once may also be automatically registered in a management list, without the need for an administrator's approval operation in registration to the management list.

Figure 6:
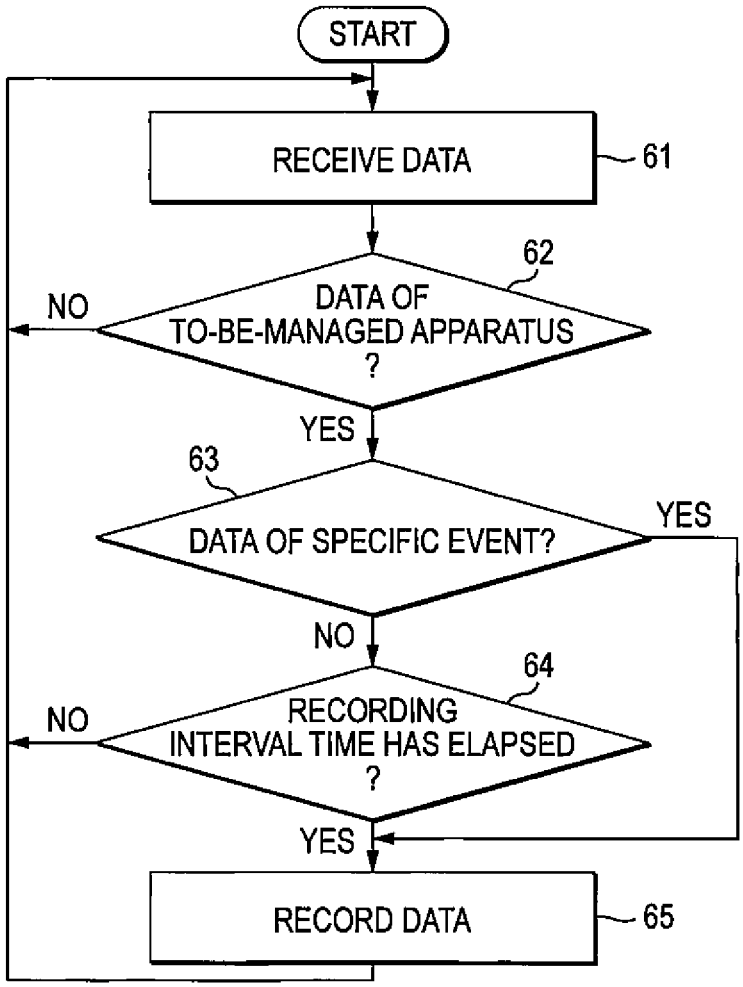
FIG. 6 is a flow chart showing the reception and recording procedure of the operation data 30 in the data managing apparatus 1 according to the embodiment.

FIG. 6 is a flow chart showing the reception and recording procedure of the operation data 30 in the data managing apparatus 1 according to the embodiment. Programs for executing the flow charts shown in FIGS. 5 and 6 are processed in parallel by a processor 11. Referring to FIG. 6, the processor 11 of the data managing apparatus 1 receives the operation data 30 transmitted from the centrifuge 2 (step 61). After receiving the operation data 30, the processor 11 identifies the transmission source from the header information 31 and determines whether or not the centrifuge 2 of the transmission source is an object to be managed, which has been approved by the administrator, using the management list (step 62). If it is not managed data, the process returns to step 61 (received operation data 30 is discarded). If it is data from a managed apparatus, it is determined whether or not it is data of a specific event (step 63).

Here, examples of the specific event include operation start of the rotor based on selection of a start button, reaching the set number of rotations after acceleration of a rotor, start of deceleration of the rotor using a stop button, start of deceleration of the rotor when a set time has elapsed, occurrence of a certain error, stopping of the rotor after deceleration of the rotor, door open, door close, vacuum pump ON, vacuum pump OFF, control state change (rotation speed, temperature, and the like) caused by changing of operational conditions during the operation, and login of a user to the centrifuge 2 or logout. Depending on the administrator's policy, the specific event is data of an event, which is to be recorded in the data managing apparatus 1, in addition to the information periodically transmitted from a centrifuge.

Figure 7:
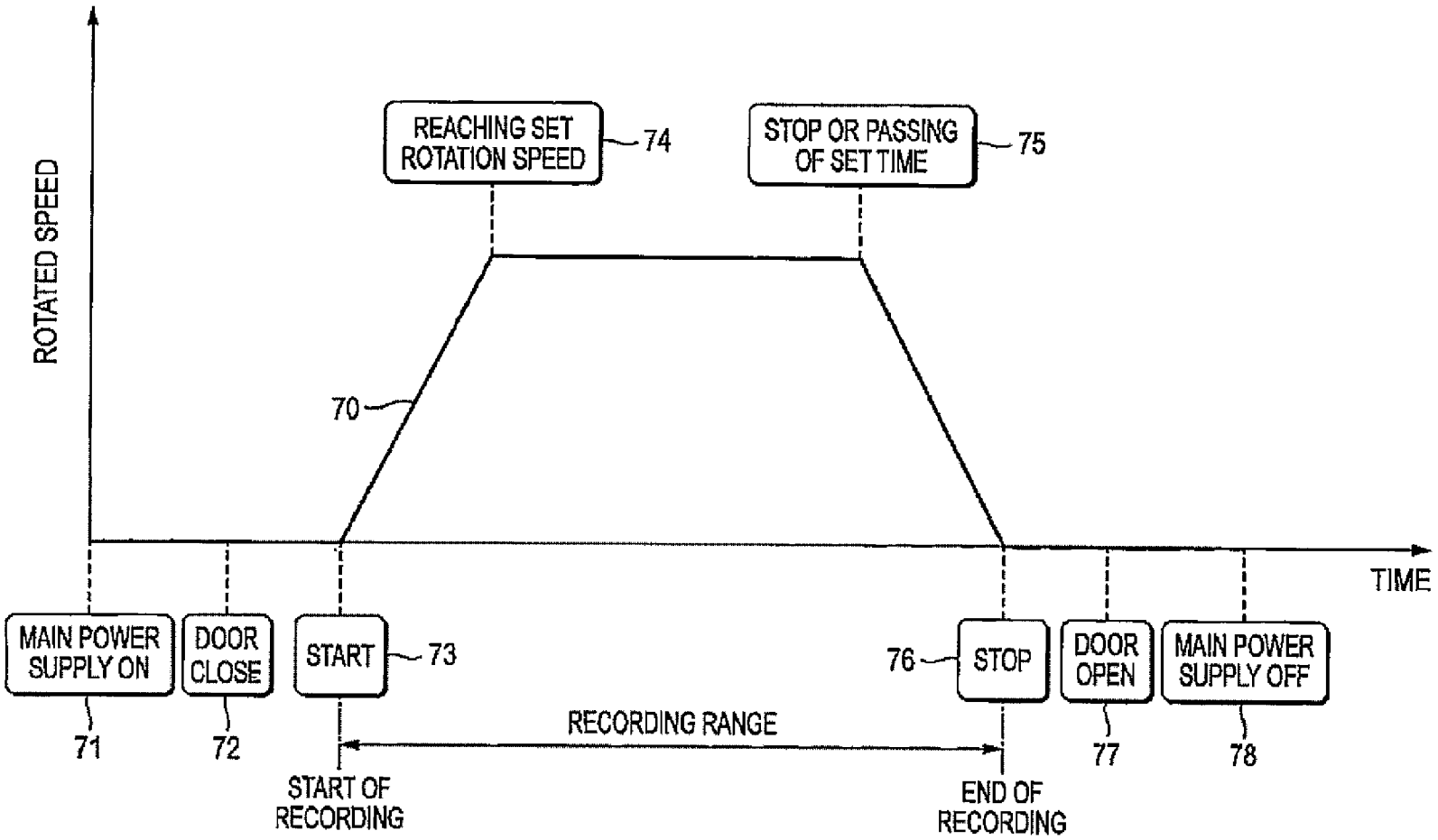
FIG. 7 is a view for explaining a specific event.

FIG. 7 is a view for explaining a specific event. The centrifuge 2 starts transmission of data to the data managing apparatus 1 according to the flow chart shown in FIG. 4 when a main power supply is turned on (71). Then, the operator sets a sample in the rotor and then closes a door (72) and presses the start button (73) to increase the rotation speed of the rotor 22 as shown by the speed curve 70. When the rotation speed reaches the set rotation speed (74), an operation is performed at the set fixed rotation speed for a predetermined time. When a stop button is pressed by the operator or an operation for the set time ends (75), the rotor slows down to stop (76). Then, the operator opens the door (77) to take out the sample. In order to end the centrifuge operation, the operator turns off the power switch (78) so that transmission of data from the centrifuge 2 to the data managing apparatus 1 ends. In the embodiment, an event (specific event) to be recorded according to the administrator's policy can be arbitrarily set, and it is unconditionally recorded when the data managing apparatus 1 receives the operation data 30 in a specific event.

If it is not an event of specific data in step 63 of FIG. 6, it is determined whether or not a recording interval time in the data managing apparatus 1 has elapsed. If the recording interval time has not elapsed, the received operation data 30 is discarded without being recorded and the process returns to step 61 (step 64). The recording interval time is an interval at which the data managing apparatus 1 records the operation data 30. For example, even in the case where the centrifuge 2 transmits the operation data 30 every 10 seconds, the data managing apparatus 1 can thin out and record the received operation data 30 not only every 10 seconds but also every 30 seconds or every 60 seconds. Thus, even if the record timing is set asynchronously, it is sufficient only to change the setting of a recording interval time at the data managing apparatus 1 side because it is not necessary to change any setting at the centrifuge 2 side.

If the recording interval time has elapsed in step 64, the received operation data 30 is recorded on the storage device 13, and the process returns to step 61 (steps 64 and 65). If it is an event of specific data in step 63, the operation data 30 is recorded regardless of whether or not the recording interval time has elapsed (steps 63 and 65). Moreover, for the operation data 30 recorded on the storage device 13, the entire content of the operation data 30 shown in FIG. 3 does not need to be recorded and only required information may be extracted from the operation data 30 and be recorded.

As described above, according to the embodiment, the operation data 30 is spontaneously transmitted from the centrifuge 2, in which the IP address of the data managing apparatus 1 is registered, to the data managing apparatus 1 at predetermined intervals. Since the data managing apparatus 1 is connected to the network 3 and is in an ON state accordingly, the data managing apparatus 1 can collect the operation data 30 effectively from the centrifuge 2 whose transmission function is set to ON. Moreover, in the embodiment, only the centrifuge 2 which is in an ON state performs spontaneous communication. Accordingly, since it is not necessary to send a command of a request for transmission of the operation data 30 from the data managing apparatus 1, lines of a network can be efficiently used. In addition, since the data managing apparatus 1 automatically collects the unique information of the centrifuge 2, which sets the data managing apparatus 1 as a transmission destination, it is possible to easily register a management list which is to be managed. As a result, time and effort for management can be significantly reduced.

Second Embodiment

Figure 8:
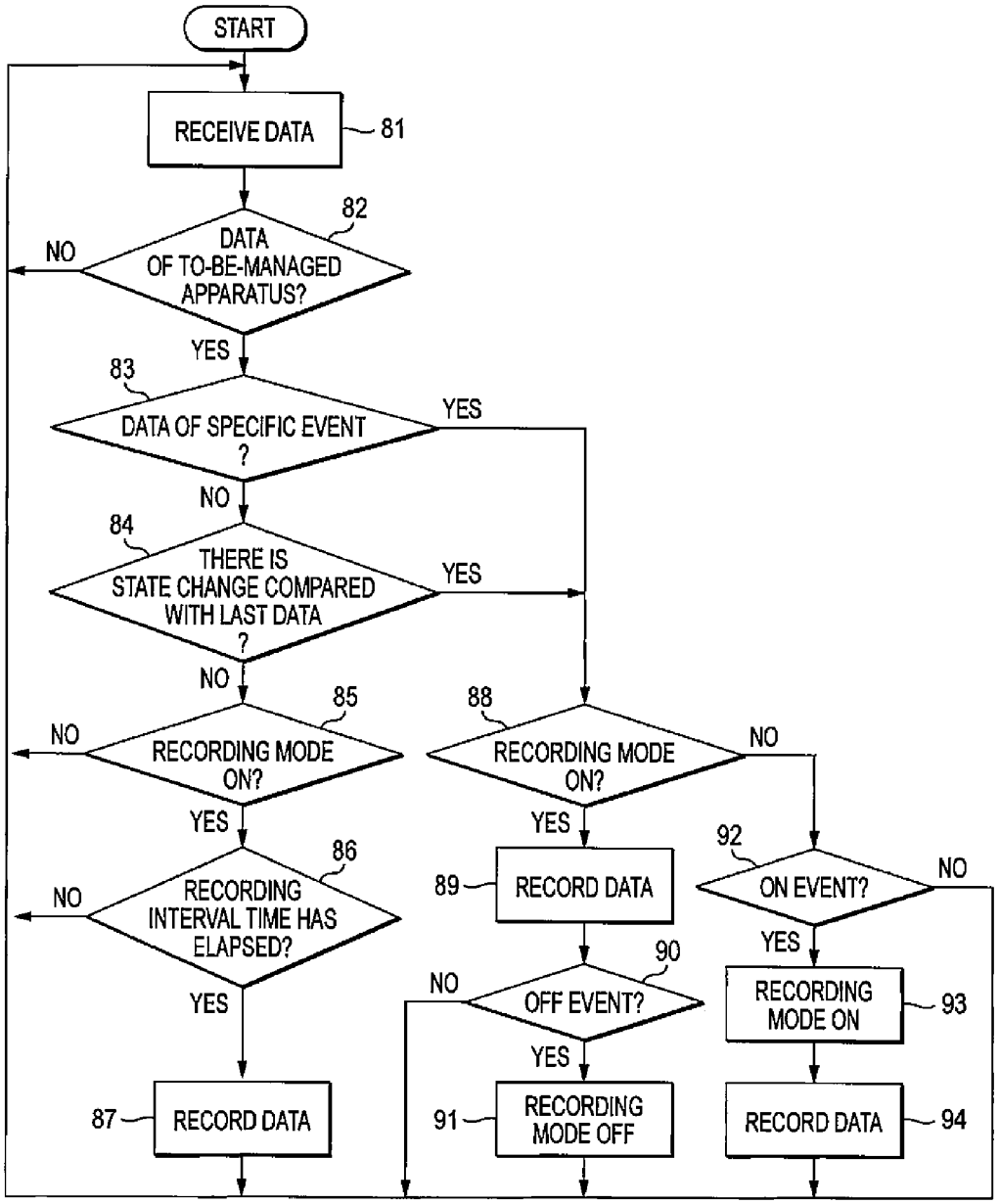
FIG. 8 is a flow chart showing the reception and recording procedure of the operation data 30 in the data managing apparatus 1 according to a second embodiment.
Figure 9:
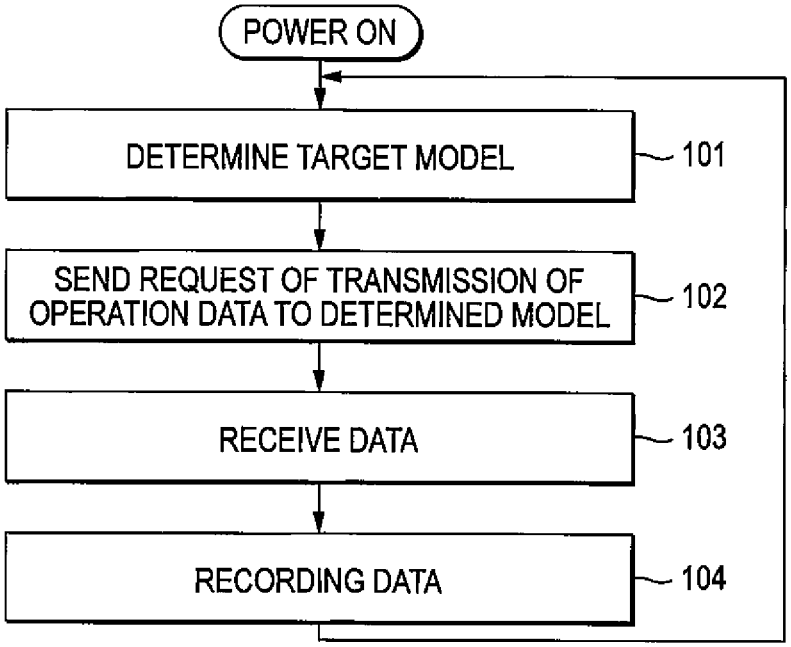
FIG. 9 is a flow chart showing the reception and recording procedure of the operation data 30 in a data managing apparatus in the related art.

Next, the reception and recording procedure of the operation data 30 in the data managing apparatus 1 according to a second embodiment will be described using the flow chart shown in FIG. 8. In the control procedure shown in this flow chart, setting in the centrifuge 2 does not need to be changed at all, and it can be realized only by changing a program executed in the processor 11 of the data managing apparatus 1. The processor 11 of the data managing apparatus 1 receives the operation data 30 transmitted from the centrifuge 2 (step 81). After receiving the operation data 30, the processor 11 identifies the transmission source from the header information 31 and determines whether or not the centrifuge 2 of the transmission source is an object to be managed using the management list (step 82). If it is not managed data, the process returns to step 81. If it is managed data, it is determined whether or not it is data of a specific event (step 83). In the case of a specific event, the process proceeds to step 88.

If it is not an event of specific data in step 83, it is determined whether or not there is a state change in the received data compared with the data received last. If there is a state change, the process proceeds to step 88 in order to record the data unconditionally (step 84). If there is no state change, the process proceeds to step 85 to determine whether or not the "recording mode" is ON. If the recording mode is OFF, that is, if it is not necessary to record the data received from the centrifuge 2, the process returns to step 81 (step 85). Here, the "recording mode" is a setting regarding whether to record the operation data 30 of the centrifuge 2 at the data managing apparatus 1 side. For example, in the case of transmitting the test data in maintenance work or the like, the "recording mode" may be set to OFF so that recording is not performed.

If the "recording mode" is ON in step 85, it is determined whether or not a recording interval time in the data managing apparatus 1 has elapsed. If the recording interval time has not elapsed, the process returns to step 81 (step 86). If the recording interval time has elapsed, the received operation data 30 is recorded and the process returns to step 61 (steps 86 and 87).

Step 88 branched from step 83 or 84 is a routine which takes unconditional recording of the operation data 30 into consideration without considering whether or not the recording interval time in the data managing apparatus 1 has elapsed. This is because when there is a specific event or there is a change from the last state, recording the operation data at that time is important to the centrifuge operation information collecting system.

First, it is determined whether or not the "recording mode", in which the data managing apparatus 1 records the data received from the centrifuge 2, is set to ON (step 88). If the recording mode is ON, the received operation data 30 is recorded (step 89), and it is determined whether or not the operation data is an "OFF event" (step 90). For example, the "OFF event" is stopping of the centrifuge 2 (76 in FIG. 7). In this case, it is not necessary to record the operation data 30 after the stopping. If an "OFF event" is detected, the data managing apparatus 1 sets the recording mode for the centrifuge 2 to OFF and returns to step 81 (steps 90 and 91). If it is not an OFF event, the process returns to step 81 without changing the recording mode (that is, with the recording mode ON) (step 90).

If the recording mode is OFF in step 88, the received operation data 30 may be discarded with no need of recording the received operation data 30 under normal circumstances. In the embodiment, however, the content of the operation data 30 is checked before discarding it in order to determine whether or not the operation data 30 is equivalent to an "ON event" (step 92). For example, the "ON event" is start of the centrifuge 2 (73 in FIG. 7). In this case, the data needs to be recorded after the start of the centrifuge 2. If it is not an "ON event" in step 92, the process returns to step 81. If it is an ON event in step 92, the recording mode of the centrifuge 2 is set to ON in the data managing apparatus 1 (step 93), and recording of the data is started (step 94). Here, the "ON event" and the "OFF event" are not necessarily limited to start and stop. For example, it is preferable to set the "ON event" and the "OFF event" on the basis of the administrator's policy such that they can be changed as in the case where door close (72 in FIG. 7) is set as the "ON event" and door open (77 in FIG. 7) is set as the "OFF event" or the case where ON of the main power supply of the centrifuge 2 (71 in FIG. 7) is set as the "ON event" and OFF of the main power supply of the centrifuge 2 (78 in FIG. 7) is set as the "OFF event".

As described above, in the second embodiment, the recording mode can be forcibly set to ON or OFF when the operation data 30 indicating a received specific event is received, regardless of the ON/OFF state of the recording mode of the data managing apparatus 1. As a result, it is possible to prevent a recording mistake and to efficiently record the operation data 30 without performing redundant recording. In addition, if the second embodiment is used, ON/OFF switching of the recording mode of the data managing apparatus 1 can be performed only by transmitting the data indicating a specific event from the centrifuge 2 to the data managing apparatus 1. As a result, the data managing apparatus 1 does not need to perform ON/OFF control of a recording mode for each centrifuge 2.

In the second embodiment, it is detected whether or not there is a state change compared with the last data in step 84. However, this step may be omitted in the case of an operation information collecting system which does not acquire any specific event from the centrifuge 2.

While the invention has been described through the above embodiments, the invention is not limited to the embodiments but various changes and modifications thereof could be made without departing from the spirit and scope of the invention. For example, although, in the embodiment, a centrifuge itself has a communication function, a method may also be used in which the centrifuge has a typical communication function, such as RS-232C, and communication is performed through an external adapter for connection with a network. In addition, although the data managing apparatus 1 and the centrifuge 2 are connected to the network 3 by cable connection through the connectors 19 and 29 in the embodiment, they may also be connected to the network 3 by wireless connection without being limited to the configuration.

What is claimed is:

1. A centrifuge comprising:

a driving unit;

a rotor configured to be rotated by the driving unit and hold a sample;

a control unit configured to control rotation of the driving unit; and a communication controller configured to communicate with an external network, wherein the control unit has an automatic transmission mode in which operation data is collected at predetermined intervals while the centrifuge is operating and the operation data is transmitted to a data managing apparatus through the network, wherein the control unit is configured such that specific event data pertaining to a specific event, including time information indicative of when the operation data is transmitted from the control unit, is automatically transmitted to the data managing apparatus, wherein the operation data is automatically transmitted without receiving a command for request of transmission of the operation data from the data managing apparatus, the operation data including (i) rotation speed of the rotor, (ii) time information indicative of when set rotation speed is reached after acceleration of the rotor, and (iii) time information indicative of when the rotor starts decelerating, wherein the operation data is transmitted at a predetermined interval and the specific event data is transmitted at the time the specific event occurs, wherein the operation data is unconditionally transmitted to the data managing apparatus when the specific event occurs, and wherein the specific event is one or more of (i) operation start of the rotor based on selection of a start button, (ii) reaching the set number of rotations after acceleration of a rotor, (iii) start of deceleration of the rotor using a stop button, (iv) start of deceleration of the rotor when a set time has elapsed, (v) occurrence of a certain error, (vi) stopping of the rotor after deceleration of the rotor, (vii) door open, (viii) door close, (ix) vacuum pump ON, (x) vacuum pump OFF, (xi) control state change caused by changing of operational conditions during the operation, (xii) login of a user to the centrifuge, or (xiii) logout.

2. The centrifuge according to claim 1, wherein whether to set the automatic transmission mode or not is selectable in the centrifuge.

3. The centrifuge according to claim 2, wherein the control unit detects whether or not the network is in a communicable state, and sets the automatic transmission mode to on so that the operation data is transmitted if the network is in a communicable state.

4. The centrifuge according to claim 3, wherein the control unit detects whether or not the network is in a communicable state, and sets the automatic transmission mode to off so that the operation data is not transmitted if the network is not in a communicable state.

5. The centrifuge according to claim 3, wherein the operation data transmitted to the network includes unique information regarding a transmission source.

6. The centrifuge according to claim 5, wherein the unique information is a unique address on the network assigned to the centrifuge.

7. The centrifuge according to claim 4, wherein the operation data transmitted to the network includes unique information regarding a transmission source.

8. The centrifuge according to claim 7, wherein the unique information is a unique address on the network assigned to the centrifuge.

9. The centrifuge according to claim 6, wherein the control unit transmits the operation data at fixed intervals until the centrifuge is powered off after the centrifuge is powered on.

10. The centrifuge according to claim 1, wherein the control unit is configured to determine whether the automatic transmission mode is valid, when the control unit determines that the automatic transmission mode is valid, the control unit automatically transmits the operational data without receiving the command, and when the control unit determines that the automatic transmission mode is not valid, the control unit does not automatically transmit the operational data without receiving the command.

11. The centrifuge according to claim 1, wherein the control unit is configured to determine whether a communication between the centrifuge and the data managing apparatus is possible, when the control unit determines that the communication is possible, the control unit automatically transmits the operational data without receiving the command, and when the control unit determines that the communication is not possible, the control unit does not transmit the operational data without receiving the command.

12. A centrifuge operation information collecting system comprising:

a plurality of centrifuges, each of which includes: a driving unit; a rotor configured to be rotated by the driving unit and hold a sample; a control unit configured to control rotation of the driving unit; and a communication controller configured to communicate with an external network and transmit operation data from the control unit at predetermined intervals; and a data managing apparatus which receives and records specific event data from the centrifuges, the specific event data pertaining to a specific event, including time information indicative of when the operation data is transmitted from the control unit, the operation data including (i) rotation speed of the rotor, (ii) time information indicative of when set rotation speed is reached after acceleration of the rotor, and (iii) time information indicative of when the rotor starts decelerating, wherein the communication controller is configured to automatically transmit the operation data without receiving a command for request of transmission of the operation data from the data managing apparatus, wherein the data managing apparatus determines unique information regarding a transmission source from the specific event data transmitted from the centrifuges and records the unique information for every model of the centrifuges, wherein the operation data is transmitted at a predetermined interval and the specific event data is transmitted at the time the specific event occurs, wherein the operation data is unconditionally transmitted to the data managing apparatus when the specific event occurs, and wherein the specific event is one or more of (i) operation start of the rotor based on selection of a start button, (ii) reaching the set number of rotations after acceleration of a rotor, (iii) start of deceleration of the rotor using a stop button, (iv) start of deceleration of the rotor when a set time has elapsed, (v) occurrence of a certain error, (vi) stopping of the rotor after deceleration of the rotor, (vii) door open, (viii) door close, (ix) vacuum pump ON, (x) vacuum pump OFF, (xi) control state change caused by changing of operational conditions during the operation, (xii) login of a user to the centrifuge, or (xiii) logout.

13. The system according to claim 12, wherein the operation data is transmitted at a predetermined interval and the specific event data is transmitted at the time the specific event occurs.

14. The system according to claim 12, wherein the control unit is configured to determine whether an automatic transmission mode is valid, when the control unit determines that the automatic transmission mode is valid, the control unit automatically transmits the operational data without receiving the command, and when the control unit determines that the automatic transmission mode is not valid, the control unit does not automatically transmit the operational data without receiving the command.

15. The system according to claim 12, wherein the control unit is configured to determine whether a communication between the centrifuge and the data managing apparatus is possible, when the control unit determines that the communication is possible, the control unit automatically transmits the operational data without receiving the command, and when the control unit determines that the communication is not possible, the control unit does not transmit the operational data without receiving the command.

* * * * *